US007540983B2

(12) United States Patent
Knohl et al.

(10) Patent No.: US 7,540,983 B2
(45) Date of Patent: Jun. 2, 2009

(54) METHOD OF PRODUCING ASPHERICAL OPTICAL SURFACES

(75) Inventors: Ernst-Dieter Knohl, Koenigsbronn (DE); Andreas Frommeyer, Aalen (DE); Hermann Schubert, Thurmansbang (DE)

(73) Assignee: Carl Zeiss SMT AG, Oberkochen (DE)

( * ) Notice: Subject to any disclaimer, the term of this patent is extended or adjusted under 35 U.S.C. 154(b) by 787 days.

(21) Appl. No.: 10/888,314

(22) Filed: Jul. 8, 2004

(65) Prior Publication Data

US 2005/0018311 A1 Jan. 27, 2005

(30) Foreign Application Priority Data

Jul. 11, 2003 (DE) ..... 103 31 390

(51) Int. Cl.
*B29D 11/00* (2006.01)
*G02B 3/00* (2006.01)

(52) U.S. Cl. ..... 264/2.7; 264/2.5; 425/808; 359/642

(58) Field of Classification Search ..... 264/2.5, 264/2.7; 425/808; 359/642
See application file for complete search history.

(56) References Cited

U.S. PATENT DOCUMENTS 3,837,125 A 9/1974 Johnson
3,917,385 A 11/1975 Caswell
4,996,545 A * 2/1991 Enomoto et al. ..... 396/53
5,353,072 A * 10/1994 Tejima et al. ..... 351/159
5,428,482 A 6/1995 Bruning et al.
5,537,262 A 7/1996 Aoki et al.
6,229,657 B1 5/2001 Holderer et al.
6,252,712 B1 6/2001 Fürter et al.
6,259,571 B1 7/2001 Holderer et al.
6,275,344 B1 8/2001 Holderer (Continued)

FOREIGN PATENT DOCUMENTS

CH 371906 10/1963

(Continued)

*Primary Examiner*—Monica A Huson
*Assistant Examiner*—Michael T Piery
(74) *Attorney, Agent, or Firm*—Wells St. John P.S.

(57) ABSTRACT

In the case of a method of producing aspherical optical surfaces of optical elements (1), in particular for use in microlithography for producing semiconductor elements, the optical element (1) is ground for example in the form of a meniscus. In a first method step, the optical element (1) is introduced into a basic form (2), which has a spherical form bed and is being held at a distance over the form bed (3). After that, an intermediate medium (6) is introduced in the basic form (2) between the optical element (1) and the form bed (3) and, subsequently the optical element (1) being removed together with the intermediate medium (6) from the basic form. Then, the spherical form bed (3) of the basic form (2) or a second basic form is transformed into an aspherical form bed (3') computationally determined in advance. The optical element (1) is then re-introduced with the intermediate medium (6) into the basic form (2) or the second basic form, the intermediate medium (6) being sucked against the form bed (3') by applying a vacuum. Subsequently, the optical element (1) deformed by the vacuum applied is spherically machined on a surface (7). Finally, after removing the vacuum, the surface (7') assumes the form of an aspherical surface.

15 Claims, 2 Drawing Sheets

U.S. PATENT DOCUMENTS

| | | | | |
|---|---|---|---|---|
| 6,307,688 | B1 | 10/2001 | Merz et al. | |
| 6,373,552 | B1 | 4/2002 | Braat et al. | |
| 6,552,862 | B2 | 4/2003 | Dieker | |
| 6,580,570 | B2 | 6/2003 | Becker et al. | |
| 6,603,615 | B2 | 8/2003 | Melzer et al. | |
| 7,175,785 | B2 * | 2/2007 | Takeda et al. | 264/1.32 |
| 2002/0001142 | A1 | 1/2002 | Osterried | |
| 2002/0021504 | A1 | 2/2002 | Bayer et al. | |

FOREIGN PATENT DOCUMENTS

| | | | |
|---|---|---|---|
| DE | 1 675 685 | | 1/1970 |
| DE | 30 30 549 | A1 | 2/1982 |
| DE | 3406907 A 1 | | 10/1984 |
| DE | 41 36 580 | A1 | 5/1993 |
| DE | 199 08 554.4 | | 3/1999 |
| DE | 198 25 716 | A1 | 12/1999 |
| DE | 199 10 947 | A1 | 9/2000 |
| EP | 0 053 463 | A2 | 6/1982 |
| EP | 0 230 277 | A2 | 7/1987 |
| EP | 0 597 209 | A1 | 9/1993 |
| EP | 0 964 281 | A1 | 12/1999 |
| EP | 1 209 500 | A2 | 5/2002 |

* cited by examiner

METHOD OF PRODUCING ASPHERICAL OPTICAL SURFACES

BACKGROUND OF THE INVENTION

1. Field of the Invention

The invention relates to a method of producing aspherical optical surfaces of optical elements, in particular for use in microlithography for producing semiconductor elements.

2. Description of the Related Art

U.S. Pat. No. 6,373,552 discloses a method of producing an aspherical surface profile on a plane-parallel plate to which a material has been applied. A thin layer is applied to the plate, the plate then being turned over and placed with the layer onto a vacuum table and sucked into place. The surface remaining free is polished flat. This produces a new surface, the plate being of a constant thickness. After releasing the plate, it is once again turned over, sucked into place again by the vacuum table and machined flat, the original aspherical profile being removed and consequently a new surface once again being created. After removal of the plate from the vacuum table, a plate of a constant thickness with the desired aspherical surface on both sides is obtained.

However, a factor contributing to the inaccuracy of this method is that short-wave and fine structures that have been produced during the machining operation on the vacuum table are transferred to the plane-parallel plate to be machined.

Furthermore, U.S. Pat. No. 3,837,125 discloses a holding device for receiving a lens blank in a machine for grinding aspherical lens surfaces. In the case of the holding device, the lens to be machined is sucked into place onto a lens holder, which has a base surface which is formed inversely in relation to the desired aspherical lens surface. The surface of the lens to be machined that is not resting on the base surface of the lens holder is ground flat. When the machined lens body is released, the lens surface assumes the desired aspherical form. Consequently, membranes that are subjected to force by actuators are used during the polishing operation.

However, this arrangement has the disadvantage that the actuators result in undesired removal of material at the edge region. The machining of the edge region of an optical surface is extremely difficult with such a membrane.

Furthermore, the production of aspherical lenses or mirror surfaces by means of a molding technique is generally known. It is critical, however, that an epoxy resin which is used for replication in a molding technique of this type remains a component part of an optical surface. The method can be used only conditionally in the production of optical surfaces with large diameters, for example in the range of 10-30 cm, since a "curling" of the epoxy resin occurs, and consequently the surfaces produced with this method are no longer usable for each precision.

SUMMARY OF THE INVENTION

The invention is based on the object of providing a quick and low-cost method which can produce axial and off-axial aspherical surfaces with high accuracy.

This object is achieved according to the invention by the optical element, wherein a) in a first method step, said optical element is introduced into a basic form which has a spherical form bed and is being held at a distance over the form bed, after which b) an intermediate medium is introduced in said basic form between said optical element and said form bed and, subsequently, said optical element is removed together with said intermediate medium from said basic form, after which c) said spherical form bed of said basic form or a second basic form is transformed into an aspherical form bed computationally determined in advance, after which d) said optical element is re-introduced with said intermediate medium into said basic form or said second basic form and said intermediate medium is sucked against said form bed by applying a vacuum, after which e) said optical element deformed by the vacuum applied is spherically machined on a free surface and f) finally, after removing the vacuum, the free surface assumes the form of an aspherical surface.

The starting point for the optical machining is an optical element pre-machined for example in the form of a meniscus. The advantage of the meniscus is a minimum application of material and a minimum weight. However, the quality of the surface does not have to meet any special requirements. An aspherical form bed is first milled into a basic form with machine accuracy, i.e. a usual accuracy of commercial machines for metal machining. The optical element is then placed in the form bed in a distance over the form bed. The cavity and the distance respectively between the optical element and the form bed is filled, free from bubbles, with silicone rubber as an intermediate medium, which is advantageously in a liquid state. This intermediate medium polymerizes and, after curing, is removed together with the optical element from the basic form.

In a second machining step, the aspherical basic form, computed in advance, is milled into the form bed with machine accuracy. If the optical element is then placed together with the silicone rubber layer into the form bed and the form is evacuated, this then produces the desired system, which in the case of spherical machining produces the required asphere after release. Since the silicone rubber provides a perfect seal, there are no air losses and a very small vacuum pump is sufficient.

It may be provided in an advantageous way that the asphere contains a radius term, a coma tern and an astigmatism term.

These terms behave orthogonally, which means that they do not influence one another. The radius term, which is introduced last into the optical surface, is chosen such that there is minimal removal of material for the coma term and astigmatism term. It should also be ensured that no tensile forces occur in the basic form.

Use of the method considerably reduces the machining time and produces extremely smooth surfaces. Since the optical element has no overrun, therefore with the known production procedures, because of the machining technology a figure error is produced at the edge. This figure error would affect the test ability in a construction. According to the invention now each optical element can be interferometrically tested free from errors toward the center in the overall system, which means that the individual optical elements can be centred on a common focus.

Advantageous refinements and developments emerge from the further subclaims and the exemplary embodiment described in principle below on the basis of the drawing.

BRIEF DESCRIPTION OF THE DRAWINGS

The individual method steps for producing an off-axial aspherical surface are represented in FIGS. 1*a* to 1*f*.

In a first step (FIG. 1*a*), an optical element 1, for example a mirror, which is produced from glass-ceramics with any desired edge form and edge course, is spherically machined on both surfaces. In the second step (FIG. 1*b*), a form bed 3, the base surface of which is spherically formed, is milled in a basic form 2, which may consist of metal, on a CNC machine with machine accuracy.

Figure 1A:
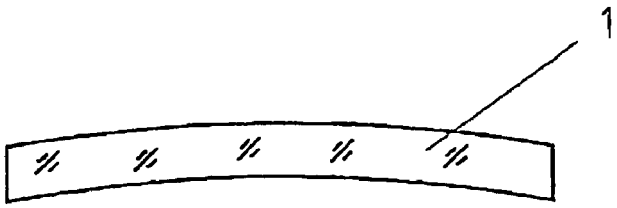
Figure 1B:
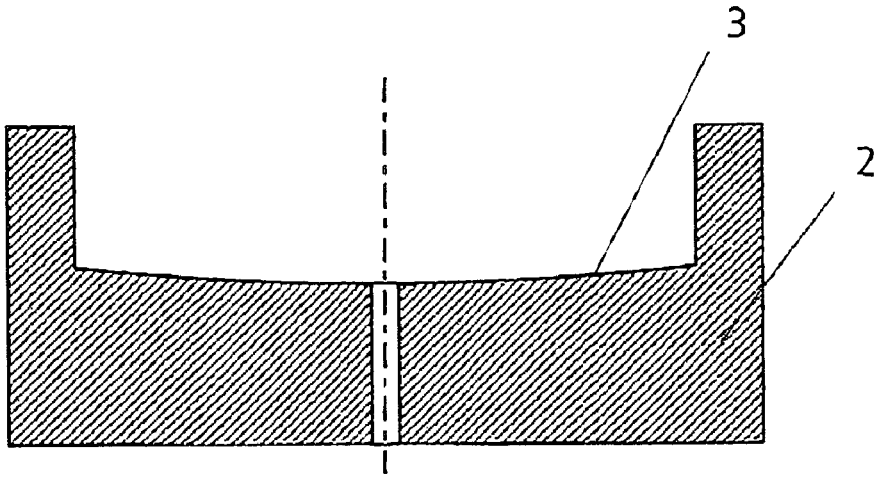
Figure 1C:
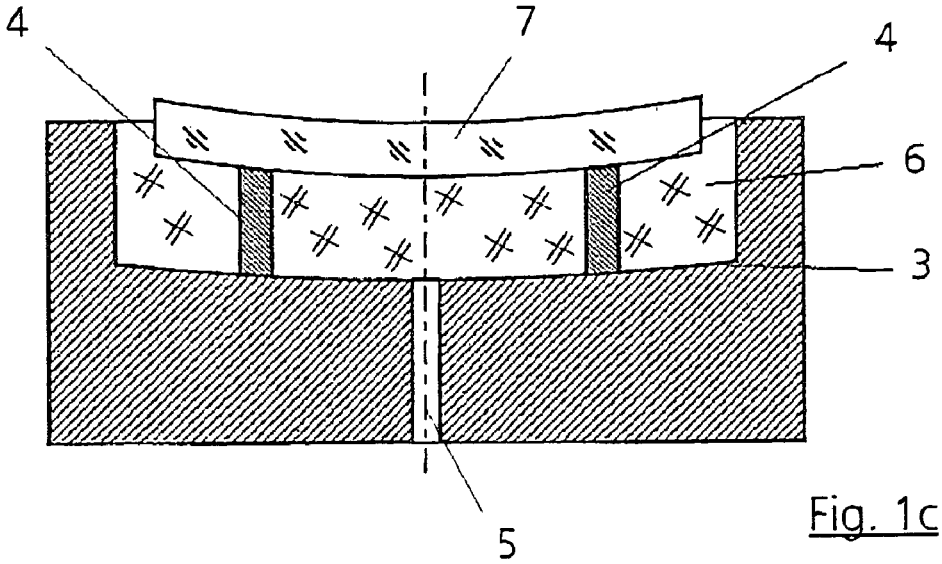

In the next step (FIG. 1*c*), the mirror 1 is then introduced into the form bed, onto spacers 4. Silicone rubber 6 is introduced through an opening 5 into the cavity between the mirror 1 and the form bed 3, whereby it should be ensured in particular that this intermediate space is filled free from bubbles. The silicone rubber layer 6 polymerizes. After the curing of the silicone rubber layer 6, the mirror 1 is removed together with the silicone rubber layer 6 from the basic form 2, the spacers 4 likewise being removed from the basic form 2 and from the silicone rubber layer 6.

Figure 1D:
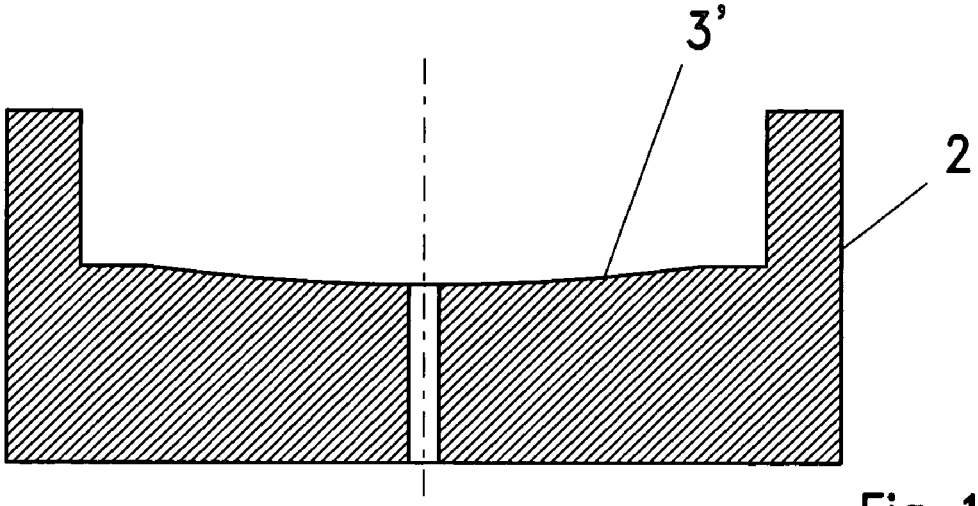

Furthermore, in another step (FIG. 1*d*), the aspherical surface computed in advance by finite element methods is introduced with machine accuracy into the previously spherical form bed 3. Alternatively also a second basic form with an aspheric form bed can be used. A separate second basic form would be provided particularly if various identical or similar optical elements should be made. In this case, the basic form with the spherical form bed can remain unchanged and then thereby various optical elements can be machined successively in the form bed 3 of the, in this case, first basic form 2 without their destruction according to the step in FIG. 1*c*. In the design of the form bed geometry, four free parameters, with which the desired asphere can be determined, are necessary. On the one hand these are the rigidity of the optical element 1, the hardness of the silicone rubber layer 6 and the thickness of the silicone rubber layer 6 and on the other hand the transfer factor for the coma and the astigmatism function. In the design, which is carried out with the aid of finite element model simulations, the transfer factor is chosen to be as great as possible, since the accuracy requirements for the form bed 3' can be reduced accordingly. With other words: a desired coma or astigmatism function is introduced into the form bed 3', for example with 10 micrometer, which then by the silicone rubber layer 6 effects a reduction to for example 1 micrometer.

If the material parameters for the silicone rubber layer 6 are not known sufficiently accurately, a fine calibration can be performed in such a way that only the coma term is produced in a first step and the coma and the astigmatism are perfectly set in a second step. This is possible since orthogonal functions are concerned.

Figure 1E:
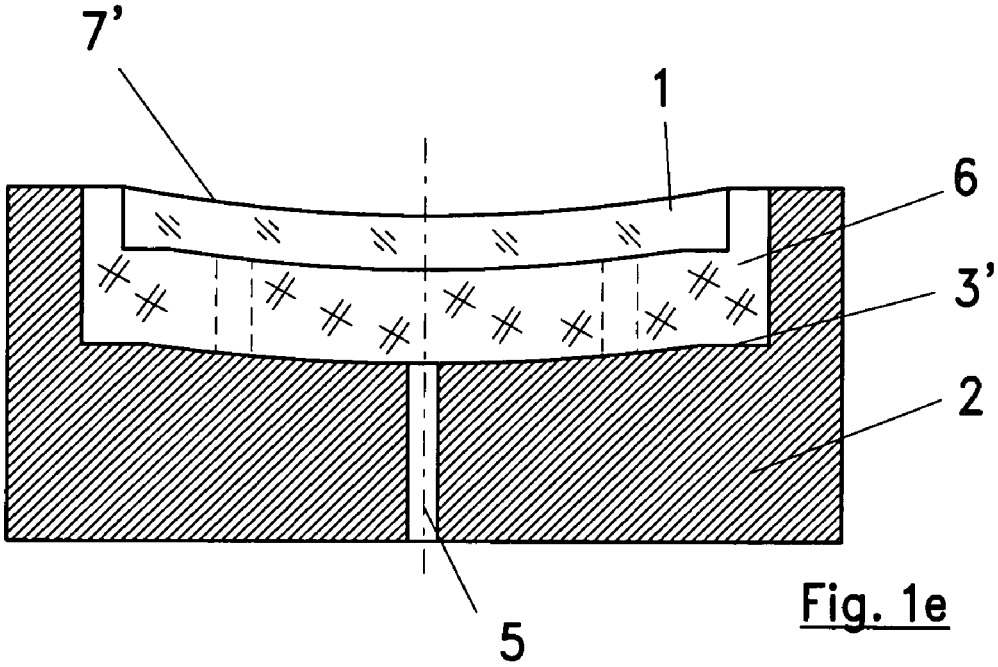

After the machining of the form bed 3', the mirror 1 embedded in the silicone rubber layer 6 is then reintroduced into the basic form 2 (FIG. 1*e*). By applying a vacuum, with the air that is still present between the silicone rubber layer 6 and the form bed 3' being sucked away through the opening 5, the silicone rubber layer 6 is adapted directly to the form bed 3' of the basic form 2. The vacuum then produced has the effect that an atmospheric pressing pressure of 1 kp/m$^2$ acts on the free surface 7 of the mirror 1, which is facing away from the side with the silicone rubber layer 6.

Introducing the silicone rubber layer 6 achieves the effect that only the longwave deformations, for example a desired 2-wavy astigmatism or coma of the form bed 3' are transferred to the mirror surface 7 to be machined.

Higher-wave and fine structures that have been produced in the form bed 3 during the machining operation with the CNC machine are not transferred in a negative way to the mirror surface 7 to be machined on account of the elasticity of the silicone rubber layer 6. Such structures would be produced in Particular whenever aspherical surfaces are produced by punctiform reworking. This means that a very good optical surface 7 is obtained by the procedure described despite of low surface quality or higher roughness of the form bed 3'.

The mirror 1 deformed by the vacuum is then spherically machined on its surface 7 by lapping and polishing. The spherical surface 7 is preferably produced by tools of a large surface, which means that high removal rates, no overrun and any desired edgings of the mirror 1 are possible. The radius produced can then be checked in a simple manner with a spherometer or else with a test glass.

Figure 1F:
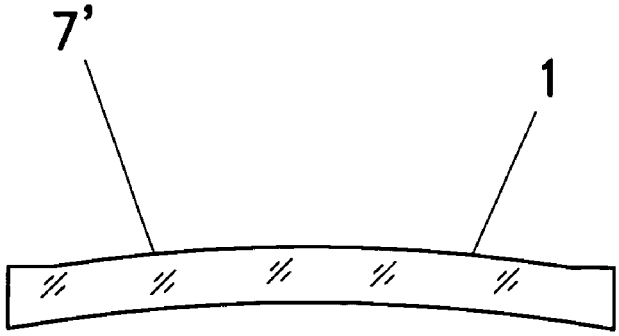

After removing the negative pressure, the mirror surface 7 assumes the desired aspherical form and can be removed from the basic form 2 (step f, according to FIG. 1*f*).

Furthermore, an ion-beam etching process can be used for the fine machining of the aspherical surface 7', whereby even greater accuracy of the aspherical mirror surface 7'is achieved.

If lenses are used instead of mirrors, the silicone rubber layer 6, which here again acts as a intermediate medium, must be removed by suitable cleaning methods.

The purpose of the silicone rubber layer 6 is to isolate the short-wave figure errors from the optical surface 7, so that the form only has to have a surface roughness accurate to within a few 0.01 mm in order to achieve a roughness in the micrometer range on the optical surface 7.

After machining of the surfaces and removal of the mirror 1 from the basic form 2, there is advantageously no warping, which is produced by bending of the surface 7 after cutting off or detaching the mirror body from the blank to the desired geometry. Furthermore, this method does not lead to a rippled surface.

Furthermore, there is a considerable advantage for the interferometric testing of the off-axial optical elements, since they can be adjusted in relation to a central reference element and undergo absolute interferometric measurement since there is no overrun.

With this method, the mirror element 1, which, if need be, is only part of a much larger overall mirror, can have axial off-axial aspherical surfaces.

It is also possible for aspherical lenses, for example for camera lenses or for spectacles, to be produced by this method.

The method makes it possible to quickly produce aspherical surfaces in optical quality, which can be examined economically and simply.

What is claimed is:

1. A method of producing aspherical optical surfaces of optical elements, wherein said optical element is pre-ground, wherein a) in a first method step, said optical element is introduced into a basic form, which has a spherical form bed and is being held at a distance over the form bed, after which b) an intermediate medium is introduced in said basic form between said optical element and said form bed and, subsequently, said optical element is removed together with said intermediate medium from said basic form, after which c) said spherical form bed of said basic form or a second basic form is transformed into an aspherical form bed computationally determined In advance, after which d) said optical element is re-introduced with said intermediate medium into said basic form or said second basic form and said intermediate medium is sucked against said form bed by applying a vacuum, after which e) said optical element deformed by the vacuum applied is spherically machined on a free surface and f) finally, after removing the vacuum, the free surface assumes the form of an aspherical surface.

2. The method as claimed in claim 1, wherein said optical element is brought in the form of a meniscus.

3. The method as claimed in claim 1, wherein a curable material is used as said intermediate medium.

4. The method as claimed in claim 3, wherein silicone rubber is used as said intermediate medium.

5. The method as claimed in claim 1, wherein said aspherical surface contains a radius term, a coma term and an astigmatism term.

6. The method as claimed in claim 1, wherein said aspherical surface is produced axially.

7. The method as claimed in claim 1, wherein said aspherical surface is produced off-axially.

8. The method as claimed in claim 1, wherein said optical element is introduced into said basic form onto spacers, after which said intermediate medium is introduced.

9. The method as claimed in claim 1 wherein the dimensioning of said intermediate medium and the geometry of said form bed are determined by model simulation based on finite element methods.

10. The method as claimed in claim 1, wherein said free surface is spherically machined by lapping and polishing processes.

11. The method as claimed in claim 1, wherein a fine machining of said aspherical surface is performed by an ion-beam etching process.

12. The method as claimed in claim 1, wherein the intermediate medium is brought into the basic form in the form of an opening.

13. The method as claimed in claim 1, wherein a mirror is used as said optical element.

14. The method as claimed in claim 13, wherein said mirror is formed from glass-ceramics with an edge form and an edge course as desired.

15. The method as claimed in claim 1, wherein a lens is used as said optical element.

* * * * *

UNITED STATES PATENT AND TRADEMARK OFFICE

CERTIFICATE OF CORRECTION

PATENT NO. : 7,540,983 B2
APPLICATION NO. : 10/888314
DATED : June 2, 2009
INVENTOR(S) : Knohl et al.

It is certified that error appears in the above-identified patent and that said Letters Patent is hereby corrected as shown below:

Column 1, line 3 – Insert --CROSS REFERENCE TO RELATED APPLICATION
This application relates to and claims priority to corresponding German Patent Application No. 103 31 190.7, which was filed on July 11, 2003, and which is incorporated by reference herein.--.

Column 2, line 40 – Replace "coma tern" with --coma term--.

Signed and Sealed this

Sixth Day of April, 2010

David J. Kappos

David J. Kappos
*Director of the United States Patent and Trademark Office*